US010514219B2

(12) United States Patent
Schafer

(10) Patent No.: US 10,514,219 B2
(45) Date of Patent: Dec. 24, 2019

(54) REMOVABLE BOLT HANDLE FOR BOLT ACTION FIREARMS

(71) Applicant: Q, LLC, Portsmouth, NH (US)

(72) Inventor: Nicholas Schafer, Portsmouth, NH (US)

(73) Assignee: Q, LLC, Portsmouth, NH (US)

( * ) Notice: Subject to any disclaimer, the term of this patent is extended or adjusted under 35 U.S.C. 154(b) by 61 days.

(21) Appl. No.: 15/700,920

(22) Filed: Sep. 11, 2017

(65) Prior Publication Data

US 2019/0078849 A1 Mar. 14, 2019

(51) Int. Cl.
*F41A 3/72* (2006.01)
*F41A 3/18* (2006.01)
*F41A 3/22* (2006.01)

(52) U.S. Cl.
CPC ..... *F41A 3/72* (2013.01); *F41A 3/18* (2013.01); *F41A 3/22* (2013.01)

(58) Field of Classification Search
CPC ..... F41A 3/72; F41A 3/18; F41A 3/22
USPC ..... 89/1.4
See application file for complete search history.

(56) References Cited

U.S. PATENT DOCUMENTS 1,209,872 A * 12/1916 Nelson ..... F41A 15/14 42/16
1,349,675 A * 8/1920 Johnson ..... F41A 3/24 42/16
1,707,538 A * 4/1929 Page ..... F41A 3/48 42/16
2,072,197 A * 3/1937 Bergmann ..... F41A 3/68 42/16
2,085,812 A * 7/1937 Loomis ..... F41A 3/22 42/16
2,338,682 A * 1/1944 Bohan ..... F41A 3/22 42/16
2,848,831 A * 8/1958 McLaughlin ..... F41A 3/12 42/16
3,005,279 A 10/1961 Brewer
3,130,513 A 4/1964 Knode
3,274,724 A * 9/1966 Brandt ..... F41A 3/22 42/16
3,330,061 A * 7/1967 Koon, Jr. ..... F41A 3/22 42/16
3,456,375 A * 7/1969 Kulikowski ..... F41A 3/22 42/16

(Continued)

OTHER PUBLICATIONS

"The Fix Rifle by Q—Stripping the Bolt" [online], Kit Badger, [Published on Apr. 13, 2018], Retrieved from the Internet: <https://www.youtube.com/watch?v=_t0pSc_Ksdl>.

(Continued)

*Primary Examiner* — Michelle Clement
(74) *Attorney, Agent, or Firm* — Fox Rothschild LLP

(57) ABSTRACT

A bolt assembly for a bolt action firearm includes a bolt body, a handle coupled to the bolt body, and a shroud that receives the bolt body and the handle. Rotation of the shroud with respect to the bolt body allows the handle to be removed from the bolt assembly. A bolt handle for a firearm includes a shaft having a radial extension at one end and a knob at an opposite end, a radial protrusion extending from the radial extension, and prongs extending from the radial extension that define a space for coupling the handle to the bolt body without engaging a firing arm of the firearm.

15 Claims, 15 Drawing Sheets

(56) References Cited

U.S. PATENT DOCUMENTS 3,584,533 A * 6/1971 Allyn ..... F41A 3/54 42/25
3,668,800 A * 6/1972 Sefried, II ..... F41A 3/18 42/16
3,673,725 A * 7/1972 Cravener ..... F41A 17/02 42/70.01
3,711,983 A * 1/1973 Allyn ..... F41A 3/54 42/75.03
3,791,060 A * 2/1974 Weaver ..... F41A 3/72 42/16
3,979,849 A * 9/1976 Haskins ..... F41A 3/22 42/16
4,015,357 A * 4/1977 Andersson ..... F41A 3/18 42/16
4,020,577 A 5/1977 Duffy
4,454,672 A 6/1984 Timari
4,698,931 A * 10/1987 Larsson ..... F41A 17/32 42/16
4,920,677 A * 5/1990 Schuerman ..... F41A 3/42 42/16
5,440,963 A * 8/1995 Szecsei ..... F41A 3/24 42/16
5,718,073 A * 2/1998 Sachse ..... F41A 3/24 42/16
5,915,934 A * 6/1999 Knight ..... F41A 3/18 42/51
5,960,574 A * 10/1999 Lameiras Guede .... F41A 19/34 42/51
6,209,249 B1 * 4/2001 Borden ..... F41A 3/22 42/16
6,401,378 B1 * 6/2002 Ockenfuss ..... F41A 17/64 42/69.02
6,508,025 B1 * 1/2003 Du Plessis ..... F41A 15/12 42/16
7,000,345 B1 * 2/2006 Kay ..... F41A 3/46 42/70.06
8,302,340 B1 * 11/2012 Irwin ..... F41A 3/22 42/16
8,381,629 B2 * 2/2013 Szecsei ..... F41A 3/24 42/16
8,397,415 B2 * 3/2013 Laney ..... F42B 5/025 42/75.02
8,533,986 B2 * 9/2013 Klotz ..... F41A 3/18 42/16
D712,002 S 8/2014 Bolton
8,925,230 B2 * 1/2015 Warburton ..... F41A 3/22 42/16
9,151,553 B2 * 10/2015 Constant ..... F41A 3/22
9,163,888 B1 * 10/2015 DiOrio ..... F41A 3/24
9,377,255 B2 * 6/2016 Karagias ..... F41C 23/04
9,658,009 B1 5/2017 Vankeuren, III
10,006,726 B1 * 6/2018 Oglesby ..... F41A 3/72
10,077,957 B1 * 9/2018 Aguf ..... F41A 3/72
2010/0281733 A1 11/2010 Constant et al.
2010/0307042 A1 * 12/2010 Jarboe ..... F41A 3/18 42/6
2011/0061523 A1 * 3/2011 Webb ..... F41A 3/42 89/128
2012/0073177 A1 * 3/2012 Laney ..... F41C 23/16 42/16
2014/0196347 A1 * 7/2014 Komatsu ..... F41A 3/66 42/75.1
2015/0233656 A1 8/2015 Karagias
2016/0252314 A1 * 9/2016 Mather ..... F41A 3/22 42/16
2018/0195818 A1 * 7/2018 Schafer ..... F41A 3/72
2018/0195823 A1 * 7/2018 Schafer ..... F41A 19/31

OTHER PUBLICATIONS

"We Knew Q LLC Was Going to Make Next-Gen ARs and Silencers, But We Didn't Expect the Fix" [online], Rob Curtis, [Published on Jan. 16, 2017], Retrieved from the Internet: <https://www.recoilweb.com/we-knew-q-llc-was-going-to-make-next-gen-ars-and-silencers-but-we-didnt-expect-the-fix-122186.html>.

"Bolt Guns—a Survey of Rem 700 Custom Actions" [online], Rob Curtis, [Published on Dec. 25, 2016], Retrieved from the Internet: <https://www.recoilweb.com/rem-700-custom-actions-109106.html>.

* cited by examiner

REMOVABLE BOLT HANDLE FOR BOLT ACTION FIREARMS

INTRODUCTION

Bolt action firearms (e.g., rifles, shotguns, handguns, etc.) require a user to manually cycle the bolt in order to chamber a round of ammunition. Bolt action rifles, for example, are commonly used for long range shooting, such as hunting, target shooting, and the like. Due to their general simplicity, bolt action firearms are considered to be reliable, accurate, and practical when a rapid rate of firing is not needed.

In the fire operating mode, the bolt assembly of the firearm is manually movable by the user via a bolt handle to feed a single round of ammunition into the receiver for firing. For example, the bolt assembly is retracted via the handle so as to eject the spent round of ammunition from the receiver. The bolt assembly may then be manually moved towards the front of the firearm via the handle to feed another round of ammunition into the receiver from the magazine.

Customization is often desirable for firearm owners who may prefer to customize their firearms to fit their style, need, and comfort. In the case of bolt action rifles, it is often desirable to customize the bolt handle in order to change its shape, size, and/or grip, as well as to adjust the clearance between the bolt handle and the body of the firearm. However, bolt handles are generally difficult to remove from the firearm since most are integrally formed with other components and/or welded in place. For instance, it is often necessary to laboriously saw off the knob of the bolt handle and then thread a shaft into the handle arm in order to install a new knob. Alternatively, while some firearms allow owners to remove the bolt handle, such removal still requires cumbersome disassembly and reassembly of the entire bolt assembly. Thus, there is a need for a bolt action firearm that allows for easy removal and replacement of the bolt handle.

SUMMARY

In one aspect, the disclosed technology relates to a bolt assembly for a bolt action firearm, the bolt assembly includes a bolt body, a handle coupled to the bolt body, and a shroud that receives the bolt body and the handle, wherein rotation of the shroud with respect to the bolt body allows the handle to be removed from the bolt assembly. In one embodiment, the handle includes a radial protrusion that clears a circumferential opening defined in the shroud when the shroud is rotated about the bolt body. In one example, the radial protrusion extends radially from the handle. In another embodiment, the bolt assembly includes a firing arm, and the handle includes prongs that define a space for coupling the handle to the bolt body without engaging the firing arm. In one example, the handle includes a circular dish cut at least partially defined over the prongs for receiving an end of a striker spring. In another example, each prong includes a protrusion adjacent to the circular dish cut. In one embodiment, the prongs comprise a pair of arms. In one example, the handle is configured for removal from the bolt assembly without disassembling the shroud from the bolt assembly. In one embodiment, the bolt assembly includes a striker cam coupled to the bolt body, wherein the striker cam includes an opening for receiving the handle and a counter bore for receiving an end of a striker spring when the handle is removed from the bolt assembly. In one embodiment, the bolt assembly is included in a firearm.

In another aspect, the disclosed technology relates to a bolt handle for a firearm that includes a bolt assembly having a firing arm. The bolt handle includes a shaft having a radial extension at one end and a knob at an opposite end, a radial protrusion extending from the radial extension, and prongs extending from the radial extension that define a space for coupling the handle to the bolt body without engaging the firing arm. In one embodiment, a circular dish cut is at least partially defined over the prongs for receiving an end of a striker spring. In one example, each prong includes a protrusion adjacent to the circular dish cut. In another example, the radial protrusion clears a circumferential opening defined in the shroud when the shroud is rotated about the bolt body. In another example, the handle is configured for removal from the bolt assembly without disassembling the bolt assembly. In one embodiment, the bolt handle is included in a firearm.

In another aspect, the disclosed technology relates to a method for removing a bolt handle from a bolt action firearm, the method including steps for removing a bolt assembly from the bolt action firearm, wherein the bolt assembly includes a bolt body received in a shroud, and the bolt handle is coupled to the bolt body; rotating the shroud with respect to the bolt body to allow the bolt handle to clear a circumferential opening on the shroud; and pulling the bolt handle to remove the bolt handle from the bolt assembly. In one example, the bolt handle is capable of being removed from the bolt action firearm without the use of tools.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
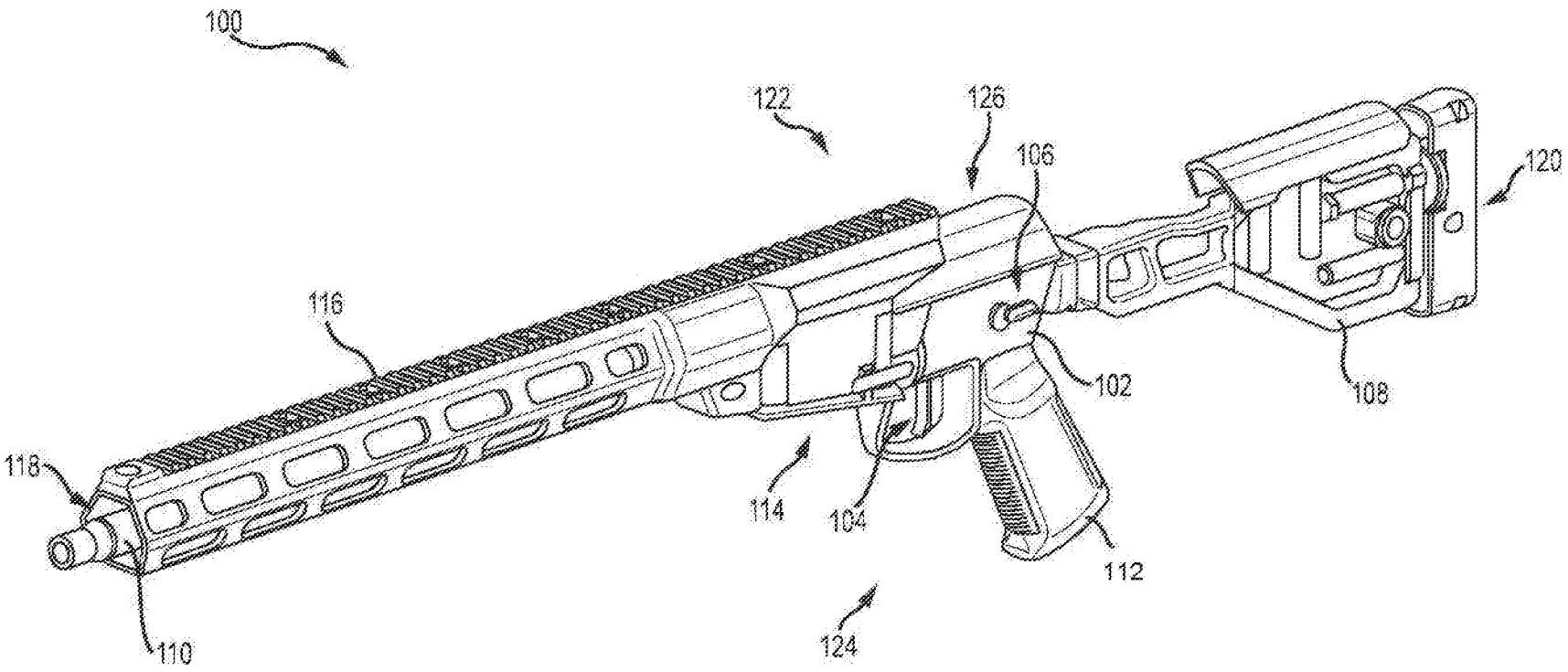
FIG. 1 is a perspective view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example firearm 100. The firearm 100 includes a receiver 102 that may house a trigger mechanism 104 and a safety mechanism 106. The firearm 100 may also include a stock 108, a barrel 110, a grip 112, a magazine well 114 defined in the receiver 102, and a rail 116. Generally, the firearm 100 includes a front 118 in the direction of the barrel 110, a back 120 in the direction of the stock 108, a top 122 in the direction of the rail 116, and a bottom 124 in the direction of the grip 112. Throughout this disclosure, references to orientation (e.g., front(ward), rear(ward), in front, behind, above, below, high, low, back, top, bottom, under, underside, etc.) of structural components shall be defined by the position of that component relative to the front 118, back 120, top 122, and/or bottom 124 of the firearm 100, regardless of how the firearm 100 may be held and regardless of how that component may be situated on its own (e.g., separated from the firearm 100).

In the example, the firearm 100 is a bolt action rifle. In alternative examples, the firearm 100 is any other bolt action firearm, such as a bolt action shotgun. The firearm 100 includes a bolt assembly 126 that is slidably disposed in the receiver 102 and will be described in further detail below. The bolt assembly 126 is removable from the receiver 102 via a bolt release assembly 186 (shown in FIGS. 3A-3C).

In operation, the firearm 100 is configured to have a safe operating mode and a fire operating mode, controlled by the safety mechanism 106. In the safe operating mode, the firearm 100 may not discharge a projectile therefrom. In the fire operating mode, the bolt assembly 126 is manually movable by the user, via a bolt handle 148 (shown in FIG. 2), to feed a single round of ammunition (e.g., projectile) (not shown) into the receiver 102 for firing. Once the trigger mechanism 104 is pulled and the round of ammunition is discharged, the bolt assembly 126 is manually cycled. For example, the bolt assembly 126 is retracted (slidably moved towards the rear 120) so as to eject the spent round of ammunition from the receiver 102. The bolt assembly 126 may then be manually moved towards the front 118 to feed another round of ammunition into the receiver 102 from the magazine. This process may then be repeated again for discharging another round of ammunition from the firearm 100.

Figure 2:
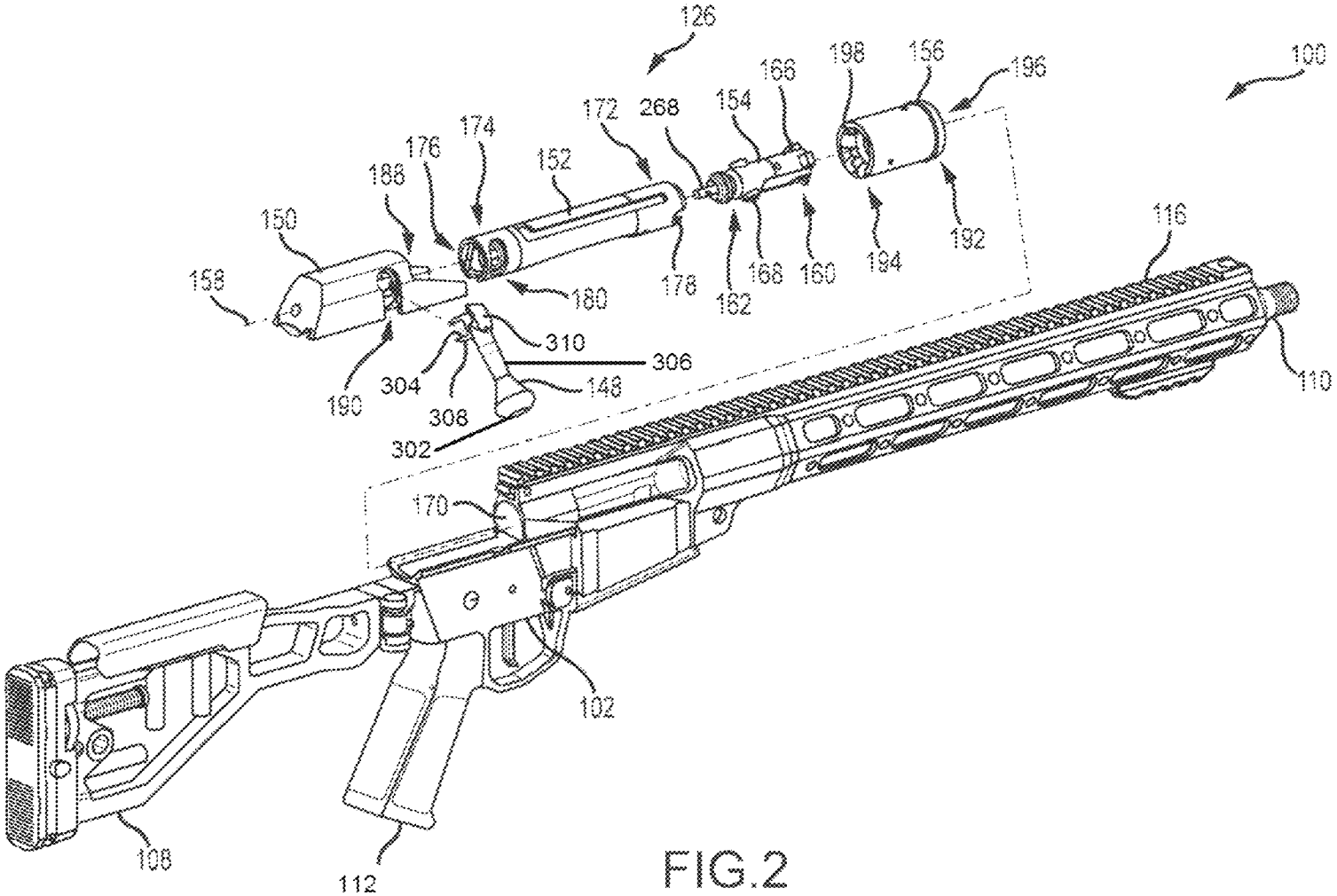
FIG. 2 is an exploded perspective view of the firearm of FIG. 1.

FIG. 2 is an exploded perspective view of the firearm 100, depicting in more detail the example bolt assembly 126. The bolt assembly 126 includes the handle 148, a shroud 150 slidably engaged with a top portion of the receiver 102, a bolt body 152 at least partially disposed in the receiver 102 and the shroud 150, and a bolt 154 coupled to the bolt body 152. A firing chamber 156 defined in the receiver 102 and coupled in flow communication with the barrel 110 is also illustrated in FIG. 2. The bolt assembly 126 defines a longitudinal axis 158 in which the shroud 150, the bolt body 152, and the bolt 154 are aligned with the firing chamber 156 from the back 120 to the front 118 of the firearm 100. As used herein, the terms "axial" and "axially" refer to directions and orientations extending substantially parallel to the longitudinal axis 158. Moreover, the terms "radial" and "radially" refer to directions and orientations extending substantially perpendicular to the longitudinal axis 158. The terms "circumferential" and "circumferentially" as used herein refer to directions and orientations extending arcuately about the longitudinal axis 158. Also, the term "orthogonal" as used herein is meant to convey, in general, a relationship between two surfaces or components that intersect one another, and is meant to be broader than "perpendicular" such that it encompasses angled relationships greater than or less than 90 degrees (i.e., angled relationships that are not 90 degrees).

The bolt 154 is substantially cylindrically-shaped and extends axially along a body axis that corresponds to the longitudinal axis 158. The bolt 154 includes a forward end 160 and an opposite back end 162, and the bolt 154 at least partially circumferentially surrounds a striker pin 268 configured to induce the discharge of the projectile. The forward end 160 includes a row of a plurality of lugs 166 extending radially outward therefrom, and the back end 162 includes at least one connection element 168. The bolt 154 is positioned axially between the bolt body 152 and the firing chamber 156 and is at least partially disposed within a top opening 170 defined in the receiver 102. The bolt 154 is rotatable within the receiver 102.

The bolt body 152 is substantially cylindrically-shaped and extends axially along a body axis corresponding to the longitudinal axis 158. The bolt body 152 includes a forward end 172 and an opposite back end 174, and defines an opening 176. The forward end 172 includes at least one corresponding connection element 178 configured to couple to connection element 168 such that the forward end 172 of the bolt body 152 is coupled to the back end 162 of the bolt 154. The back end 174 includes a handle opening 180 configured to receive a portion of the handle 148. A striker assembly 260 (shown in FIGS. 4 and 5) which includes the striker pin 268 is received in the opening 176 as described further below. The bolt body 152 is positioned axially between the handle 148 and the bolt 154 and at least partially disposed in the receiver top opening 170. The bolt body 152 is rotatable within the receiver 102 about the longitudinal axis 158 and is axially slidable within the receiver 102 along the longitudinal axis 158.

The handle 148 includes a radial extension 308 at one end which is configured to be insertable within the handle opening 180 of the bolt body 152 while the remaining portions of the handle 148 such as the knob 302 and shaft 306 remain outside the bolt body 152. The radial extension 308 of the handle 148 includes a radial protrusion 310 and prongs 304. The radial protrusion 310 prevents the handle 148 from being removed from the bolt assembly 126 when the bolt assembly 126 is attached to the firearm 100, as will be discussed in greater detail below (e.g., see, for example, FIG. 13). The prongs 304 pivotably couple to and engage the handle 148 to the bolt body 152 so as to rotate the bolt body 152 about the longitudinal axis 158 and to also move the bolt body 152 axially along longitudinal axis 158. In one example embodiment, the prongs 304 comprise a pair of arms.

The shroud 150 is slidably coupled to a top portion of the receiver 102 such that the shroud 150 moves axially along the longitudinal axis 158. For example, the shroud 150 runs on corresponding rails formed on the receiver 102. The shroud 150 is axially behind the bolt body 152 and receives at least a portion of the handle 148 and the bolt body 152. The back end 174 of the bolt body 152 is received within an axial opening 188 defined in the shroud 150 such that the bolt body 152 is rotatable therein. The radial extension 308 and radial protrusion 310 of the handle 148 are received within a circumferential opening 190 defined in a sidewall of the shroud 150 such that the handle 148 is rotatable and pivotable therein. The shroud 150 axially slides in relation to the receiver 102 when the handle 148 and bolt body 152 are axially moved.

The firing chamber 156 is coupled to the receiver 102 and is fixed in relation thereto. Additionally, the firing chamber 156 is coupled in flow communication with the barrel 110 to facilitate discharging a projectile therefrom. The firing chamber 156 is substantially cylindrically-shaped and extends axially along a body axis that corresponds to the longitudinal axis 158. The firing chamber 156 includes a front end 192 and an opposite back end 194, and defines an opening 196. The back end 194 includes a plurality of lugs 198 extending radially inward therefrom. The firing chamber lugs 198 correspond to the bolt lugs 166 such that the bolt 154 rotatably engages with the firing chamber 156. In the example, both lugs 166 and 198 are spaced circumferentially asymmetrically about the longitudinal axis 158. In alternative embodiments, the lugs 166 and 198 have any other spacing (e.g., symmetrical spacing).

Figure 3A:
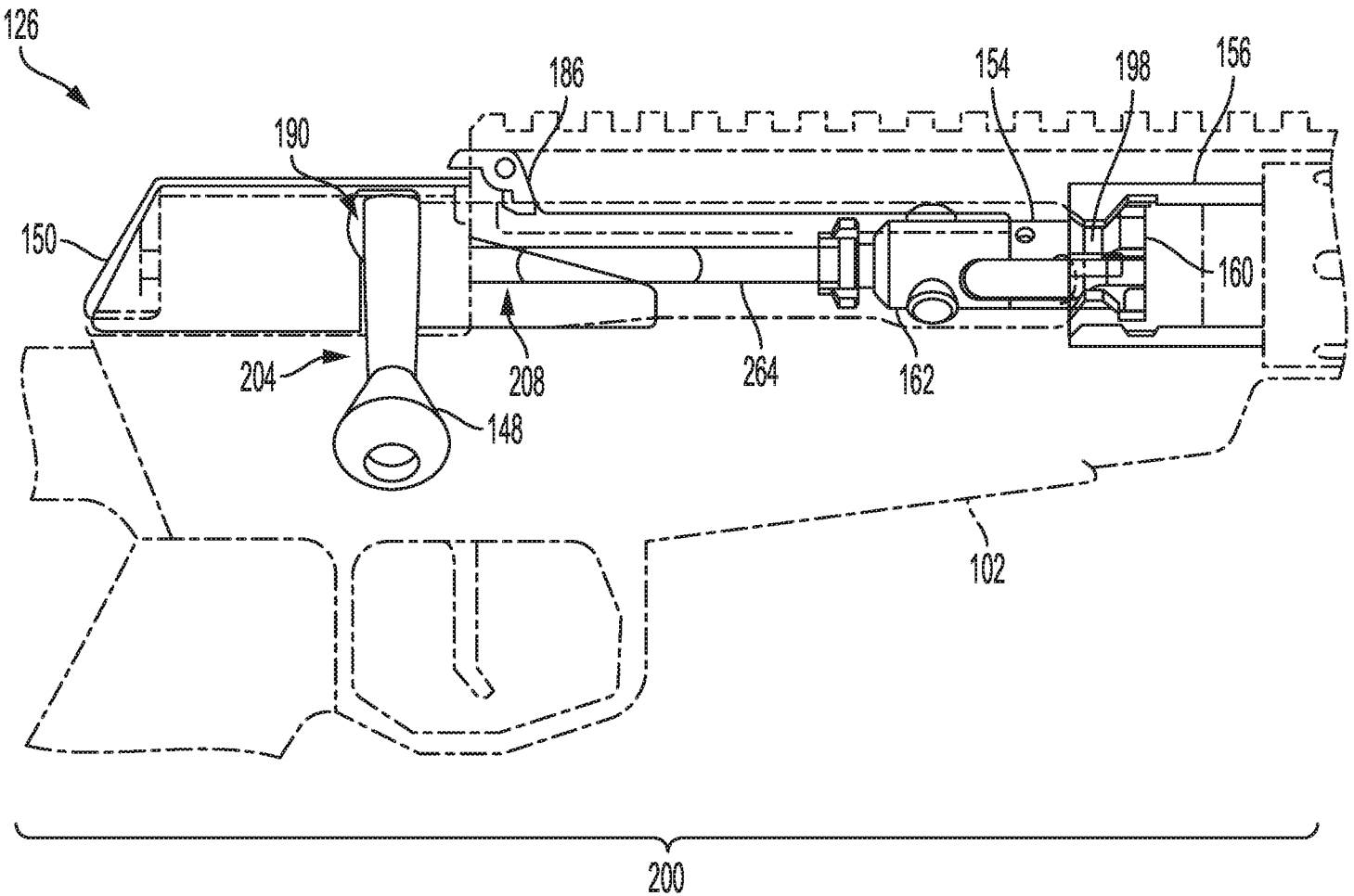
FIG. 3A is a side view of an example bolt assembly in a firing position.

FIG. 3A is a side view of the bolt assembly 126 in a firing position 200. In the firing position 200, the bolt assembly 126 is positioned in an axially forward position 208 such that the bolt 154, the bolt body 152, the shroud 150, and the handle 148 are positioned axially forward within the receiver 102. Additionally, the bolt 154, the bolt body 152, and the handle 148 are rotated in a first rotated position 204 within the receiver 102 such that the bolt 154 is engaged with the firing chamber 156 via lugs 166 and 198. The first rotated position 204 is defined by the handle 148 extending substantially downward and adjacent the receiver 102 within the circumferential opening 190, and the bolt 154 engaged with the firing chamber 156. The firing position 200 enables the trigger mechanism 104 to be pulled such that an ammunition round is discharged from the firing chamber 156 and thrust loads generated therein from the discharged round are resisted by the bolt assembly 126 through engagement of the lugs 166 and 198. Once the ammunition is fired from the firearm 100, the spent ammunition cartridge remains within the firing chamber 156. To eject the spent cartridge from the receiver 102, the bolt assembly 126 is first moved from the firing position 200 to a rotated position 216 shown in FIG. 3B.

Figure 3B:
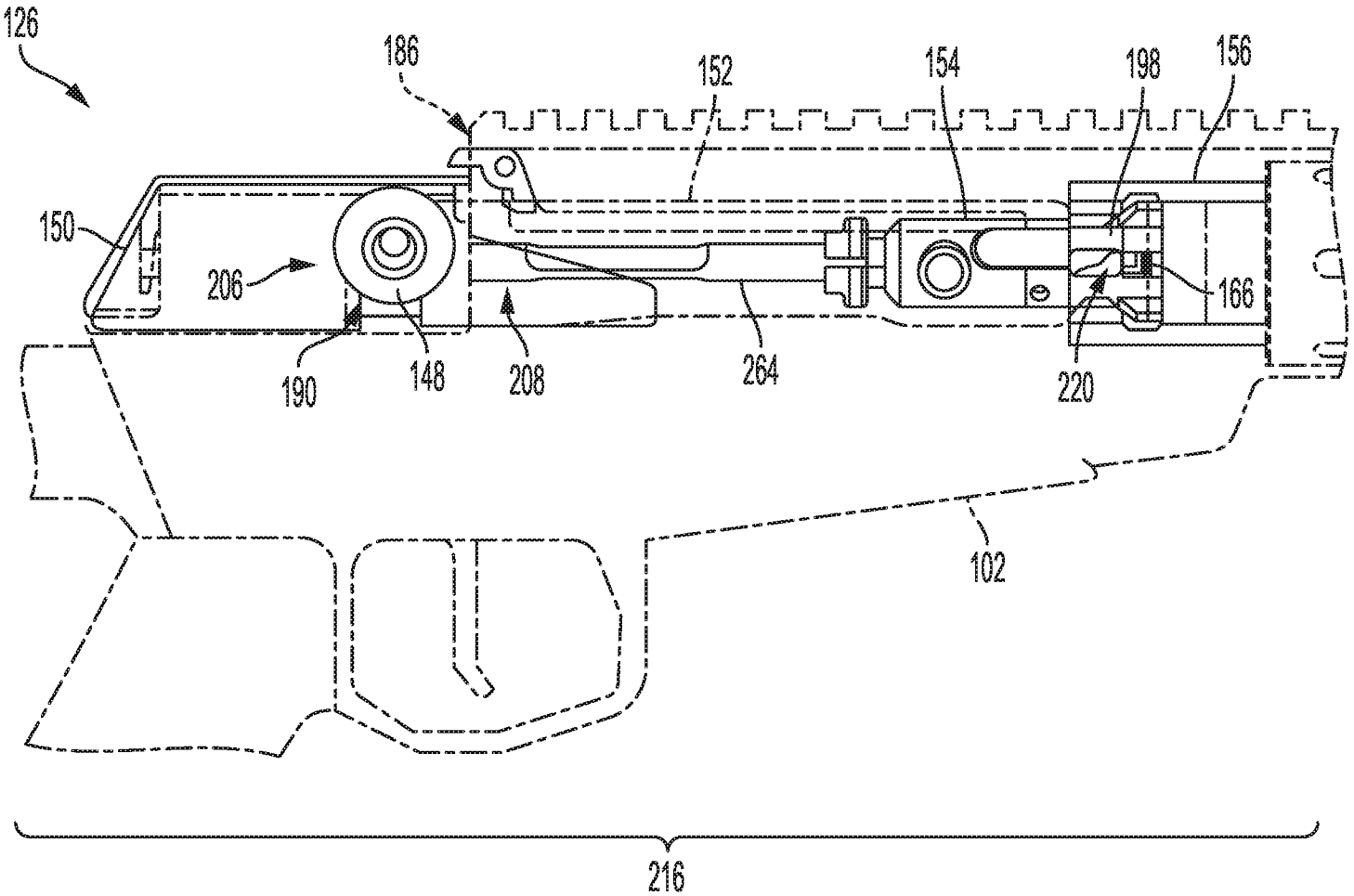
FIG. 3B is a side view of the bolt assembly in a rotated position.

FIG. 3B is a side view of the bolt assembly 126 in the rotated position 216. In the rotated position 216, the bolt assembly 126 is still positioned in the axially forward position 208 such that the bolt lugs 166 are axially forward of the chamber lugs 198 as described above. Additionally, in the rotated position 216, the handle 148 has been rotated about the longitudinal axis 158 and within the shroud circumferential opening 190 in an upwards and counter-clockwise direction from the first rotated position 204 to a second rotated position 206 towards the top 122 of the firearm 100. The second rotated position 206 is defined by the handle 148 extending substantially orthogonal to the receiver 102. As the handle 148 is rotated from the first rotated position 204 to the second rotated position 206, the radial extension 308 rotates the bolt body 152 and the bolt 154 within the receiver 102 and the shroud 150 about the longitudinal axis 158 to axially offset the bolt lugs 166 from the chamber lugs 198. In the rotated position 216, the spent ammunition cartridge remains within the firing chamber 156. However, the bolt 154 has begun to disengage with the firing chamber 156.

Figure 3C:
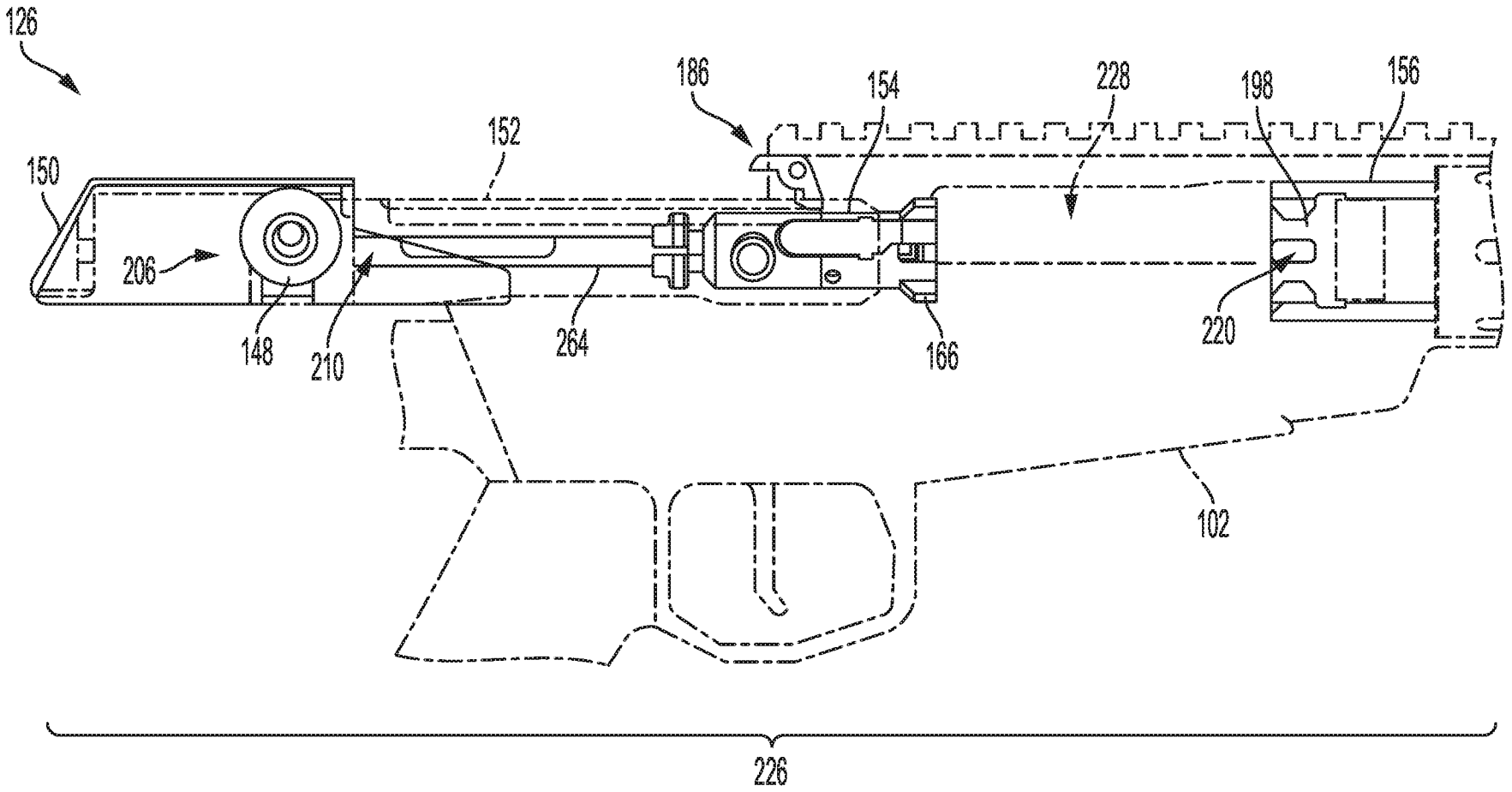
FIG. 3C is a side view of the bolt assembly in an eject position.

To eject the spent cartridge, the handle 148 is moved to an eject position 226 shown in FIG. 3C. In the eject position 226, the handle 148 is still positioned in the second rotated position 206 such that the bolt lugs 166 are axially offset with the chamber lugs 198. Additionally, the bolt assembly 126 is positioned in an axially backward position 210 in which the bolt 154, the bolt body 152, the shroud 150, and the handle 148 are positioned axially backward within the receiver 102 at a predetermined distance from the firing chamber 156. As the handle 148 is moved to the backward position 210 (e.g., an extraction pull), the bolt lugs 166 fully disengage with the firing chamber 156 by sliding through the chamber recesses 220 and are positioned axially behind the chamber lugs 198. The axial movement of the bolt 154 facilitates ejecting the spent ammunition cartridge from the receiver 102 through an opening 228.

Once the bolt assembly 126 ejects the spent ammunition cartridge and is in the eject position 226, the firearm 100 and bolt assembly 126 may be cycled through to the firing position 200 to reload ammunition into the firing chamber 156. To reload the firearm 100, the bolt assembly 126 is moved from the eject position 226 back to the firing position 200. For example, the handle 148 is moved axially along the longitudinal axis 158 while maintaining the second rotated position 206 in a direction towards the front 118 of the firearm 100. This axial movement from the handle 148 axially moves the shroud 150, the bolt body 152, and the bolt 154 from the backward position 210 to the forward position 208 such that the bolt 154 is at least partially inserted into the firing chamber opening 196. By maintaining the handle 148 in the second rotated position 206 the bolt lugs 166 are axially aligned with the chamber recesses 220 such that the bolt 154 may move into the firing position 200 with the bolt lugs 166 axially forward of the chamber lugs 198. Additionally, this axial forward movement of the bolt 154 facilitates inserting a new ammunition round into the firing chamber 156. In at least some examples, the new ammunition round is manually fed into the opening 228 before moving the bolt assembly 126 back into the firing position 200. In other examples, the new ammunition round is provided from a magazine coupled to the magazine well 114.

Once the handle 148, the bolt body 152, and the bolt 154 are moved in the axially forward position 208, the handle 148 is rotated in a downward or clockwise direction from the second rotated position 206 to the first rotated position 204 to engage the bolt 154 with the firing chamber 156 in preparation for discharging the firearm 100. Moving the handle 148 back into the first rotated position 204 axially aligns and engages the bolt lugs 166 and the chamber lugs 198 to restrict backward axial movement of the bolt 154. This cycling of the bolt assembly 126 between the firing position 200, the rotated position 216, and the eject position 226 as illustrated in FIGS. 3A-C may occur at will to discharge ammunition from the firearm 100 and to eject the spent ammunition cartridges therefrom. While the figures herein and the description in regards to operating the firearm 100 describe the handle 148 as being on the right side of the firearm 100 when looking from the back 120 to the front 118 of the firearm 100, it is appreciated that the handle 148 of the bolt assembly 126 may also be positioned on the left side of the firearm 100.

Figure 4:
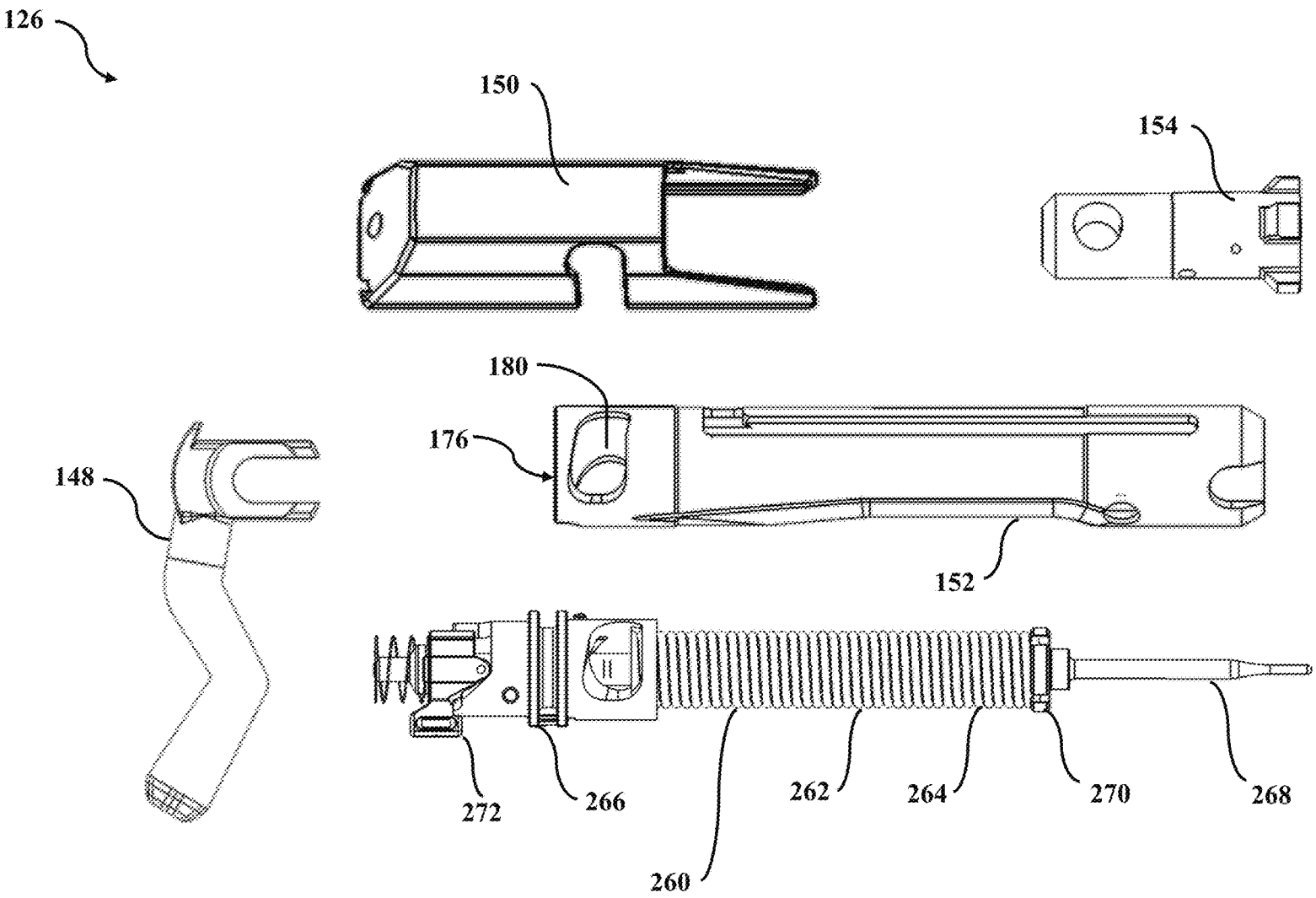
FIG. 4 is a top view of an example bolt assembly that has been disassembled.

FIG. 4 shows a disassembly of the bolt assembly 126 including the shroud 150, the bolt handle 148, the bolt body 152, the bolt 154, and a striker assembly 260. The striker assembly 260 includes a striker spring 262 positioned around a striker shaft 264, a striker head 258 (shown in FIG. 5), and the striker pin 268. In one example, the striker shaft 264, the striker head 258, and the striker pin 268 are integral with one another such that they form a one-piece firing arm. In another example, the striker shaft 264, the striker head 258, and the striker pin 268 are separate components that are coupled together such that they form a multi-piece firing arm. The striker assembly 260 further includes a striker spring retainer 270, a striker cam 266, and a striker priming ring 272. The striker cam 266 has an opening 274 for receiving the radial extension 308 of the bolt handle 148. The striker assembly 260 is received in the opening 176 of the bolt body 152 such that the striker pin 268 partially extends outside the bolt body 152 and the opening 274 of the striker cam 266 aligns with the handle opening 180 of the bolt body 152. When the bolt body 152 is coupled to the bolt 154, the bolt 154 at least partially circumferentially surrounds the striker pin 268.

Figure 5:
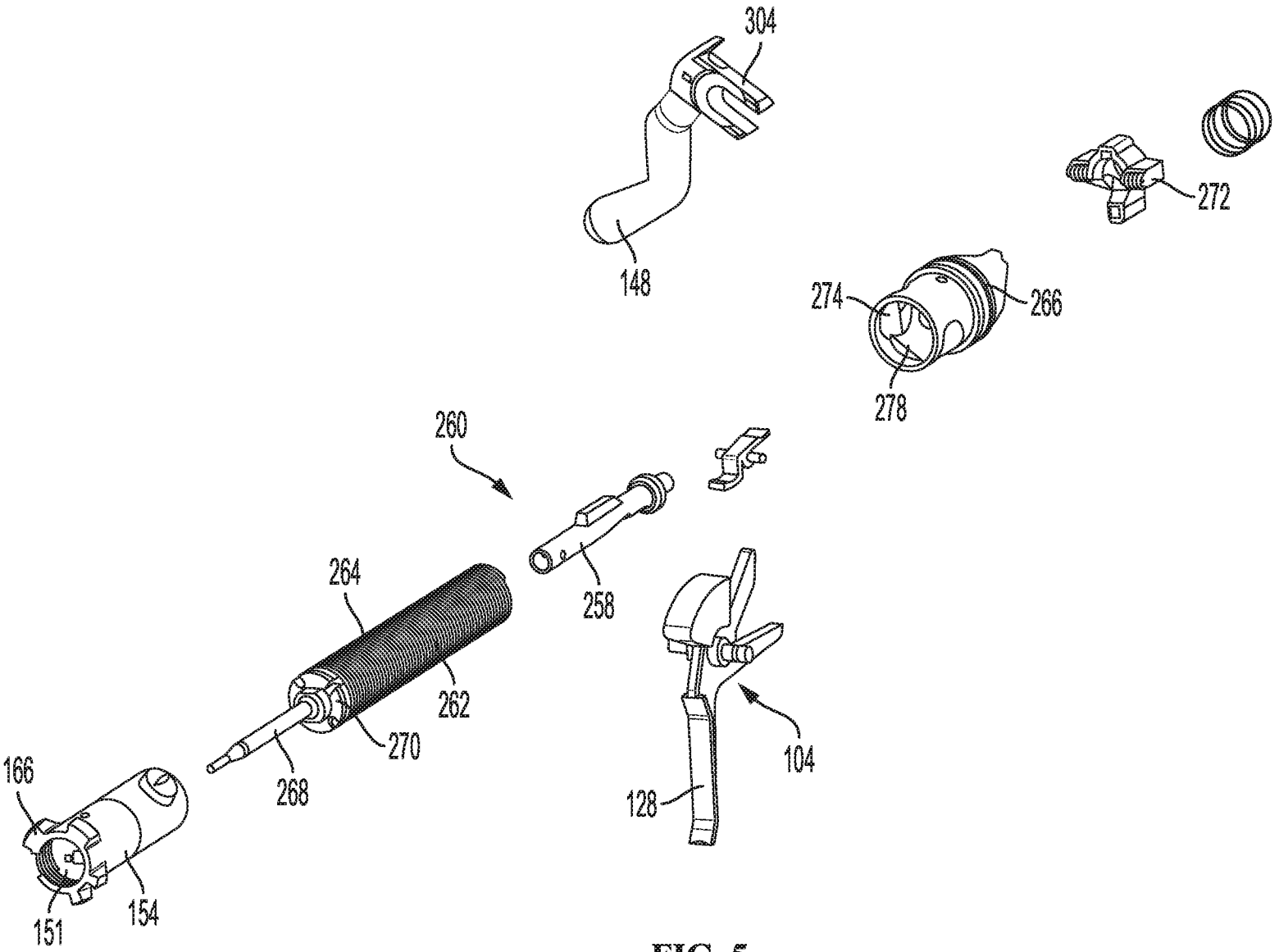
FIG. 5 is an exploded view of an example bolt assembly and striker assembly.

FIG. 5 shows an exploded view of the striker assembly (including the striker head 258) along with other components of the firearm 100 such as the handle 148 and the trigger mechanism 104. The striker shaft 264 is surrounded by the striker spring 262. While the bolt assembly 126 is movable within the receiver 102 of the firearm 100, the striker pin 268, striker shaft 264, and striker head 258 are movable within the bolt assembly 126 to facilitate the discharging of a round of ammunition. For example, the striker spring retainer 270 is movable longitudinally in the bolt body 152 along with the striker pin 268, the striker shaft 264, and the striker head 258; however, the striker cam 266 is not movable longitudinally in the bolt body 152. In the firing position 200, the striker pin 268 protrudes from a face 151 of the bolt 154 so that it can strike a rear portion of a round of ammunition that is seated within the firing chamber 156. The movement of the striker pin 268 is facilitated by the striker spring 162 and the movement of the trigger mechanism 104.

Figure 6:
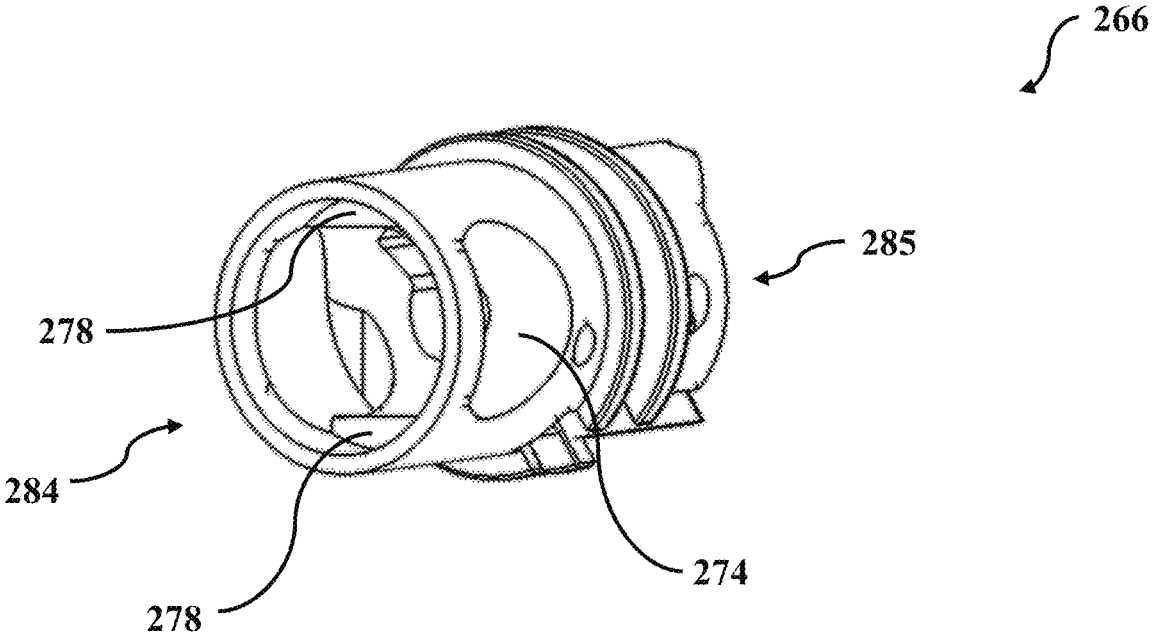
FIG. 6 is a front perspective view of an example striker cam.

FIG. 6 shows a front perspective view of the striker cam 266. The striker cam 266 includes a front 284 and a rear 285, each corresponding with the front 118 and rear 120 of the firearm 100 when the bolt assembly 126 is inserted in the firearm 100. The striker cam 266 includes the opening 274 for receiving the radial extension 308 of the handle 148. The striker cam 266 also includes a counter bore 278 having top and bottom portions.

Figure 7:
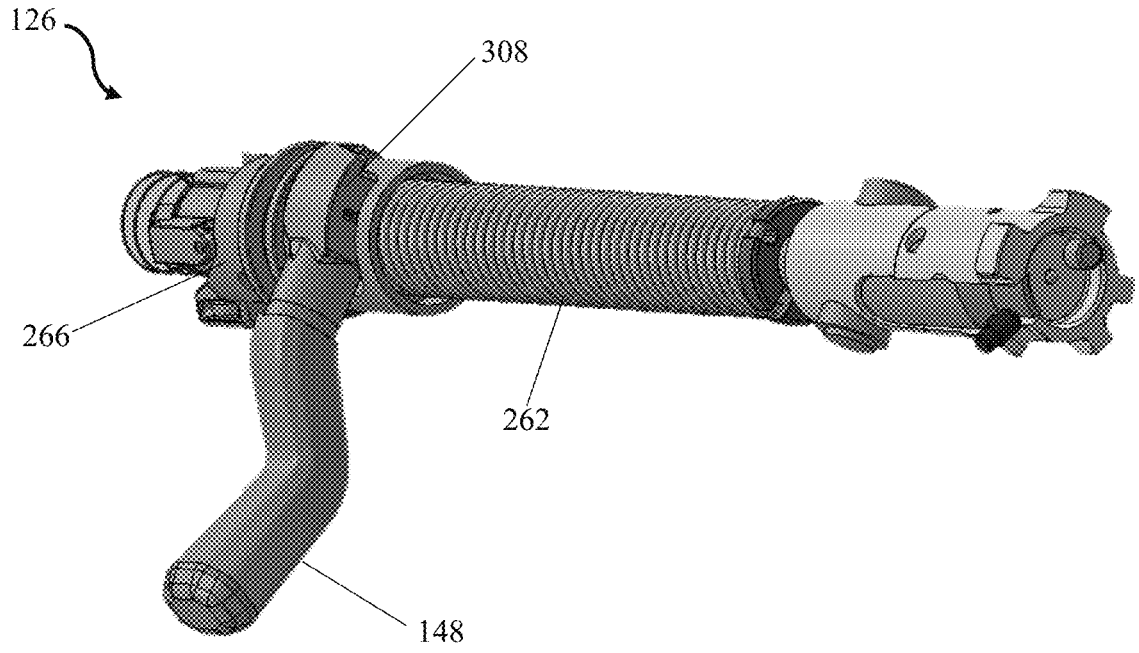
FIG. 7 is a perspective view of an example bolt handle in a bolt assembly exposed.
Figure 8:
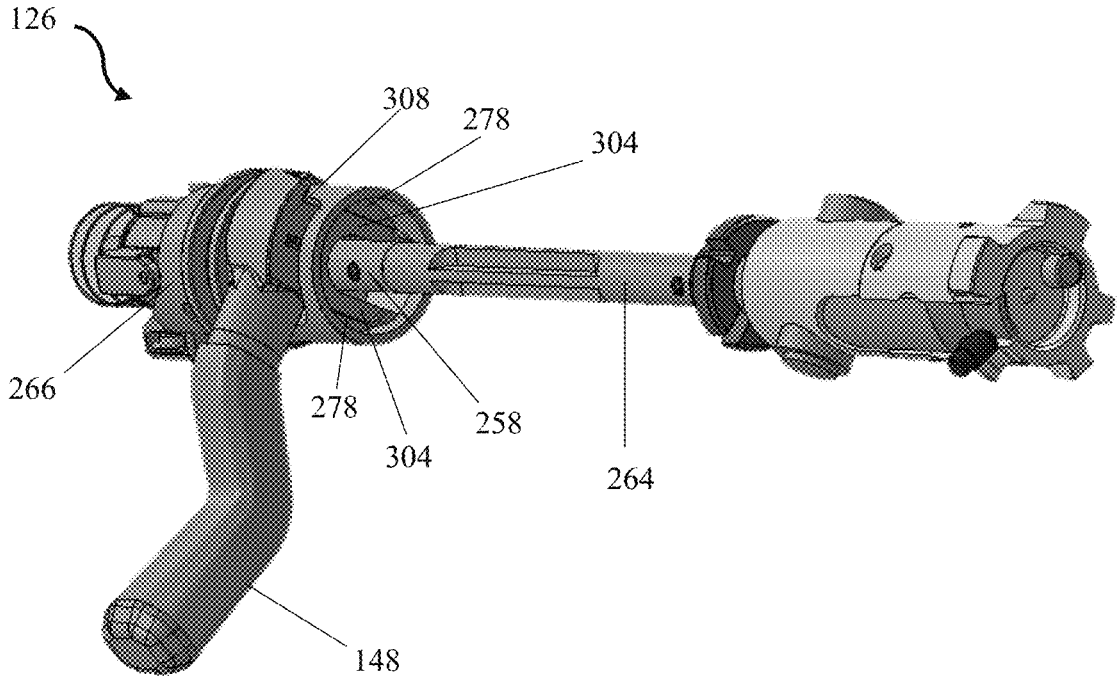
FIG. 8 is a another perspective view of the bolt handle in the bolt assembly of FIG. 7.

FIG. 7 shows the bolt assembly 126 with the shroud 150 and the bolt body 152 removed exposing the striker spring 262 inside the bolt assembly 126. FIG. 8 is another view of the bolt assembly 126 with the striker spring 262 removed exposing the striker head 258 and the striker shaft 264. FIGS. 7 and 8 show that the radial extension 308 of the handle 148 is in contact with the striker spring 262 when the handle 148 is inserted in the bolt assembly 126. More specifically, when the radial extension 308 of the handle 148 is inserted in the opening 274 of the striker cam 266, the prongs 304 of the radial extension 308 are marginally forward (in an axial direction) of the top and bottom portions of the counter bore 278, and the top and bottom portions of the counter bore 278 are, respectively, above and below the prongs 304 of the radial extension 308. The positioning of the prongs 304 of the radial extension 308 with respect to the top and bottom portions of the counter bore 278 allows the striker spring 262 to bias the radial extension 308 of the handle 148 when inserted in the bolt assembly 126, and when the handle 148 is removed from the bolt assembly 126, the striker spring 262 is held by the top and bottom portions of the counter bore 278. FIG. 8 also shows that the prongs 304 allow the handle 148 to fit around (i.e., bypass) the striker head 258 so that the handle 148 does not contact the striker head 258 (see, for example, FIG. 8). Accordingly, when the handle 148 is inserted in the bolt body 152, the handle 148 contacts the cam 266 and bolt body 152 for rotating the bolt body 152 about the longitudinal axis 158 and for axially sliding the bolt body 152 along the longitudinal axis 158 without contacting the striker head 258. Thus, the handle 148 can be removed from bolt assembly 126 without having to remove or disengage the striker head 258.

Figure 9:
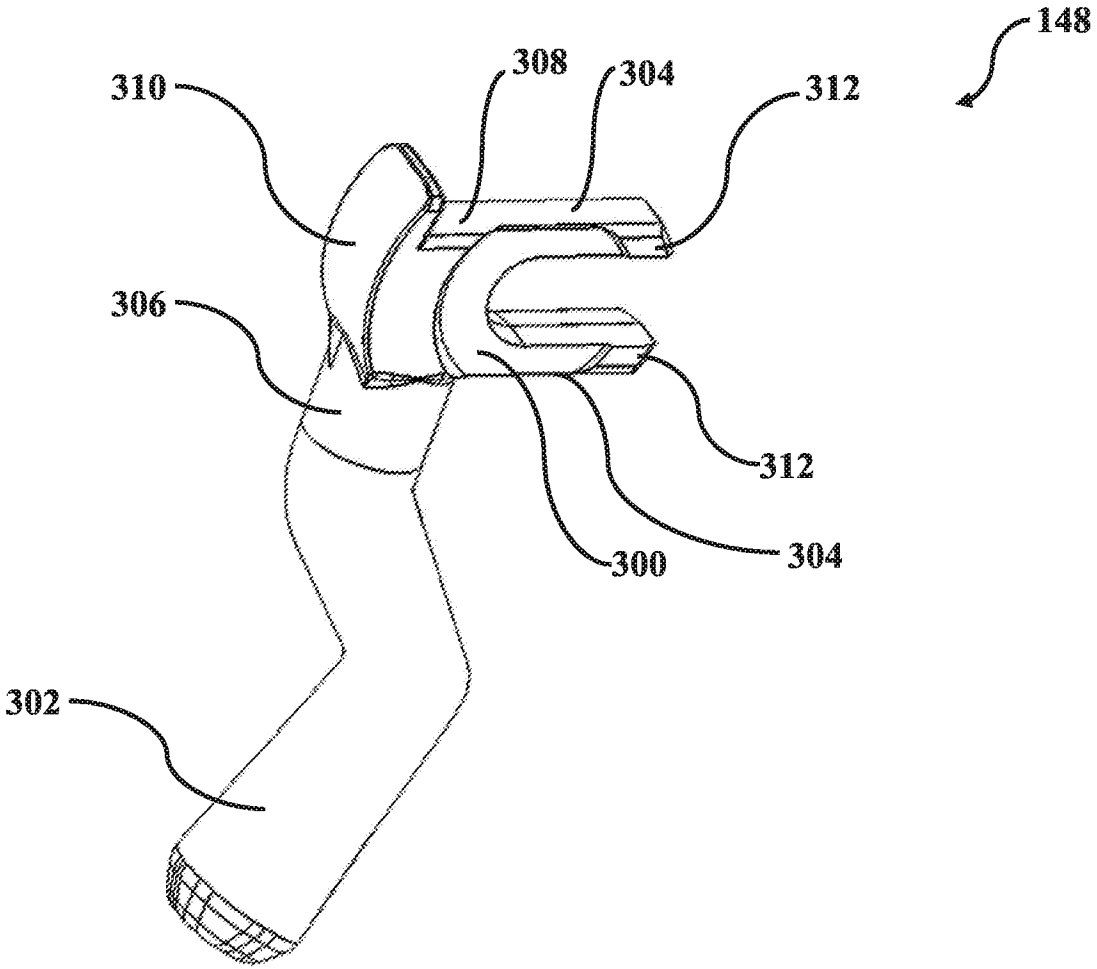
FIG. 9 is a front perspective view of an example bolt handle.
Figure 10:
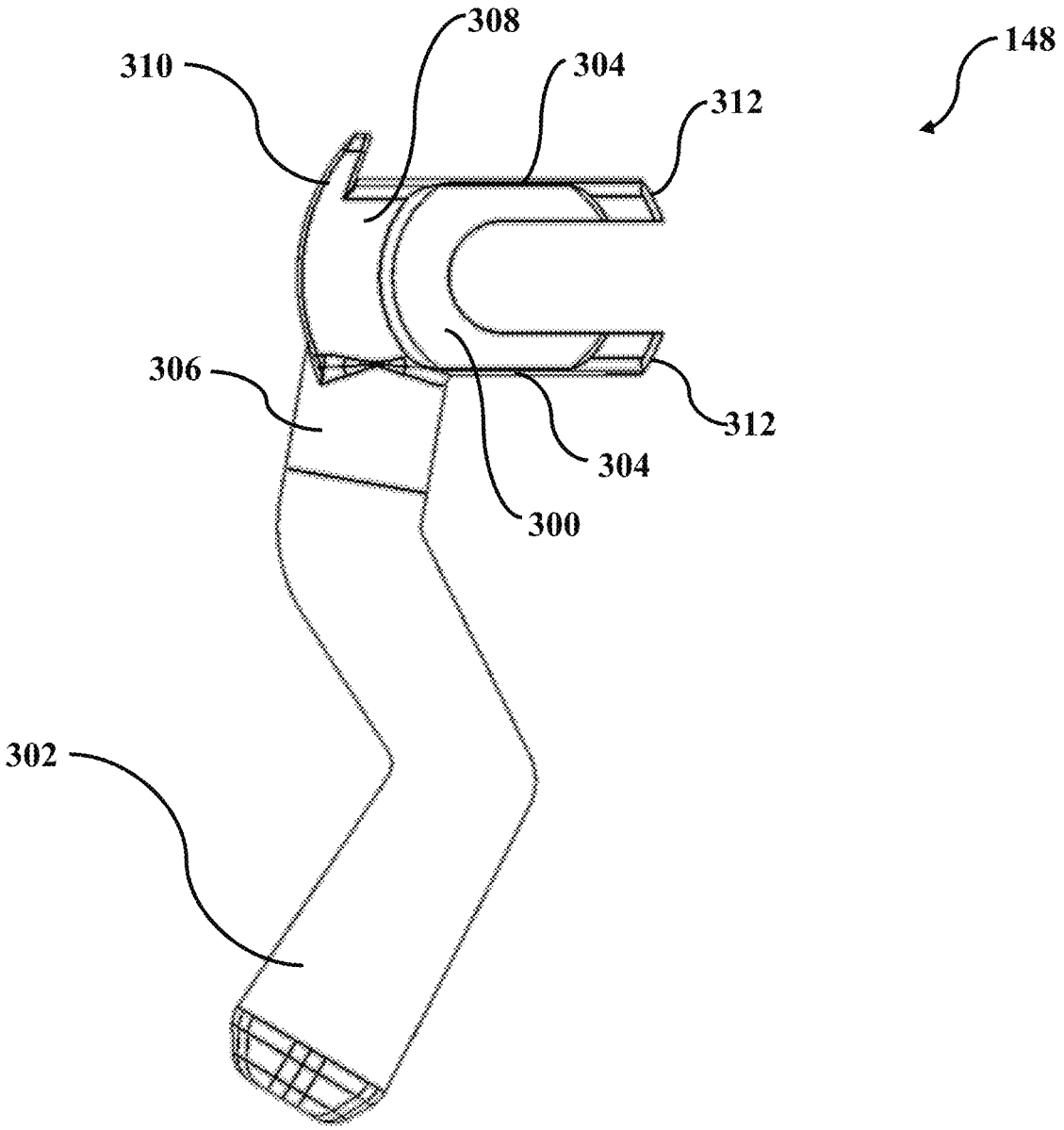
FIG. 10 is a front view of the handle of FIG. 9.
Figure 11:
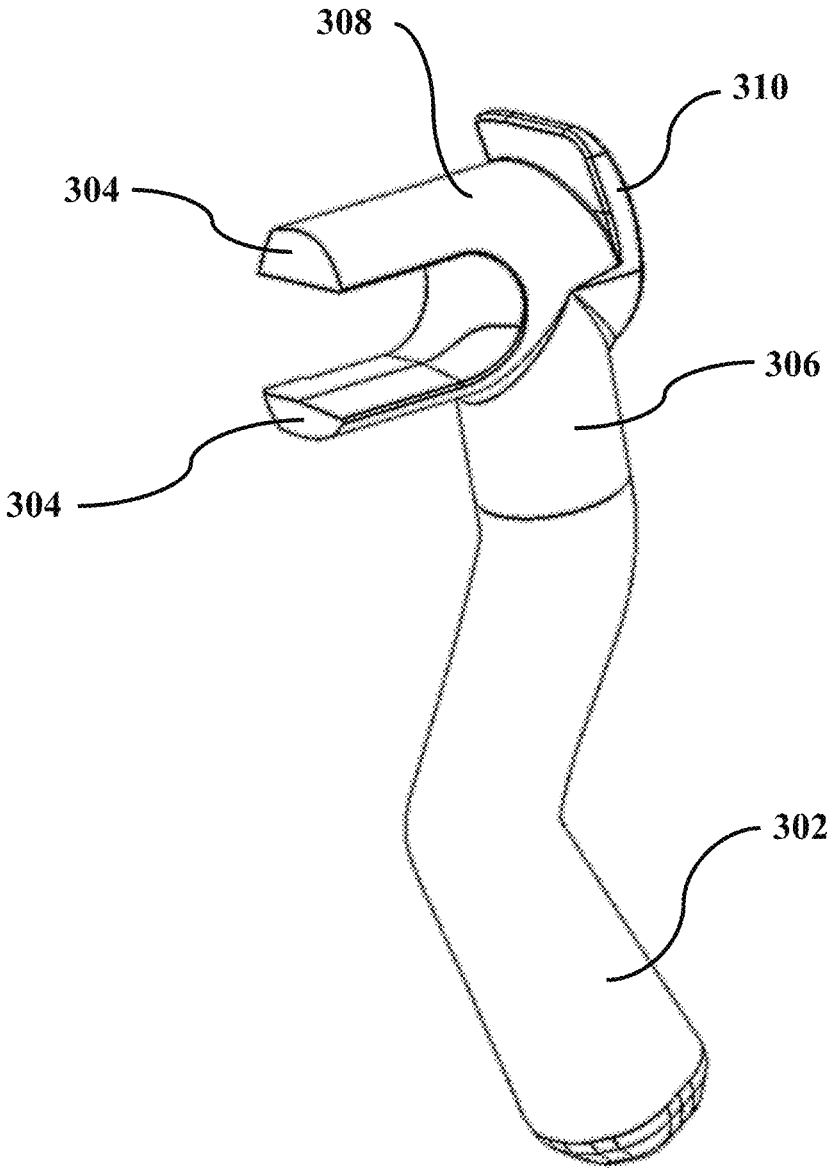
FIG. 11 is a rear perspective view of the handle of FIG. 9.

FIG. 9 shows a front perspective view of the handle 148; FIG. 10 shows a front view of the handle 148; and FIG. 11 shows a rear perspective view of the handle 148. The radial extension 308 is located on an end of the handle 148 opposite an end having a knob 302. The knob 302 allows a user to grip and manipulate the handle 148. The radial extension 308 has a curved shape and includes the prongs 304 which are substantially orthogonal to the shaft 306 of the handle 148. A circular dish cut 300 is formed at least partially on the surface of the radial extension 308 for receiving an end of the striker spring 262. In one example, the circular dish cut 300 is at least partially formed on the radial extension 308 and is at least partially formed over the prongs 304 of the handle 148. In another example, the circular shape of the dish cut 300 extends beyond the radial extension 308 and the prongs 304 such that the circular dish cut 300 is an incomplete circle. The striker spring 262 when received in the circular dish cut 300 applies a compression force on the radial extension 308 so that the handle 148 is at least partially held in place by the striker spring 262 when inserted in the bolt assembly 126. The handle 148 includes protrusions 312 at each distal end of each prong 304 adjacent to the circular dish cut 300. The protrusions 312 are chamfered around their perimeters. The handle 148 also includes the radial protrusion 310 which extends from the radial extension 308, and curves in a direction towards the prongs 304.

Figure 12:
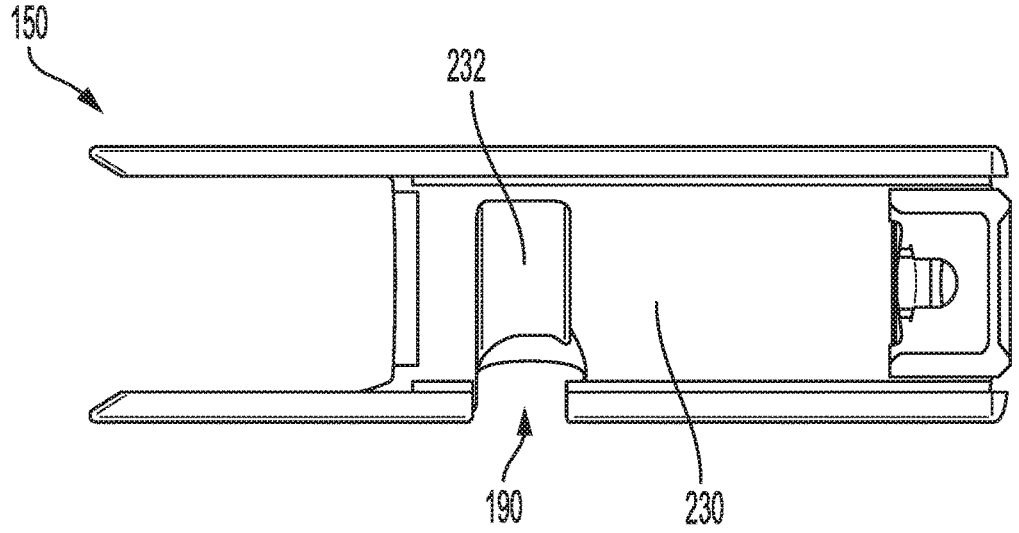
FIG. 12 is a bottom view of an example shroud.

FIG. 12 shows a bottom view of the shroud 150. A circumferential groove 232 is formed on an inner circumferential surface 230 proximate the circumferential opening 190 of the shroud 150. The circumferential groove 232 has a width substantially similar to the width of the circumferential opening 190, and the circumferential groove 232 extends in a direction substantially parallel to the circumferential opening 190. In plan view, the circumferential groove 232 is substantially rectangular in shape, and in cross-section view, the circumferential groove 232 is substantially arc-shaped to match the curved shape of the radial protrusion 310 of the handle 148. In one example embodiment, at least a portion of the radial protrusion 310 of the handle 148 is engaged with the circumferential groove 232 when the handle 148 is positioned in the bolt assembly 126.

Figure 13:
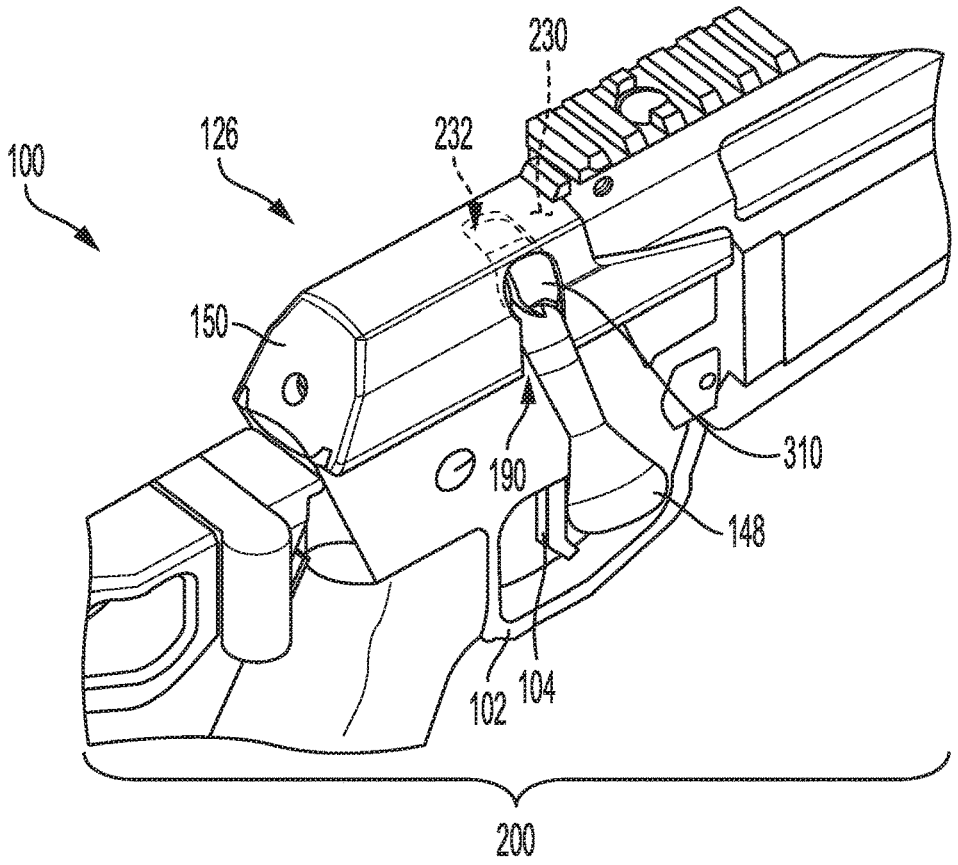
FIG. 13 is a perspective view of an example bolt handle in the shroud of FIG. 12.

FIG. 13 shows the handle 148 positioned in the bolt assembly 126. When the handle 148 is rotated in a downward or clockwise direction from the second rotated position 206 to the first rotated position 204, at least a portion of the radial protrusion 310 slides within the circumferential groove 232. Similarly, at least a portion of the radial protrusion 310 slides within the circumferential groove 232 when the handle 148 is rotated in an upward or counterclockwise direction from the first rotated position 204 to the second rotated position 206. The radial protrusion 310 prevents the handle 148 from clearing the circumferential opening 190 in the shroud 150 when the shroud 150 is assembled to the receiver 102 of the firearm 100.

For users interested in customizing the firearm 100, the handle 148 can be replaced with another handle without dissembling the bolt assembly 126 or using any tools. To remove the handle 148, the bolt assembly 126 must first be removed from the receiver 102 of the firearm 100. To remove the bolt assembly 126 from the receiver 102, a user opens the bolt assembly 126 by rotating it 45 degrees, pulls the bolt assembly 126 to the back 120 of the firearm 100 via the bolt handle 148, and then depresses the bolt release assembly 186 (shown in FIGS. 3A-3C) which releases the bolt assembly 126 from the receiver 102. Afterwards, the user can simply slide the bolt assembly 126 out of the back 120 of the firearm 100.

Figure 14:
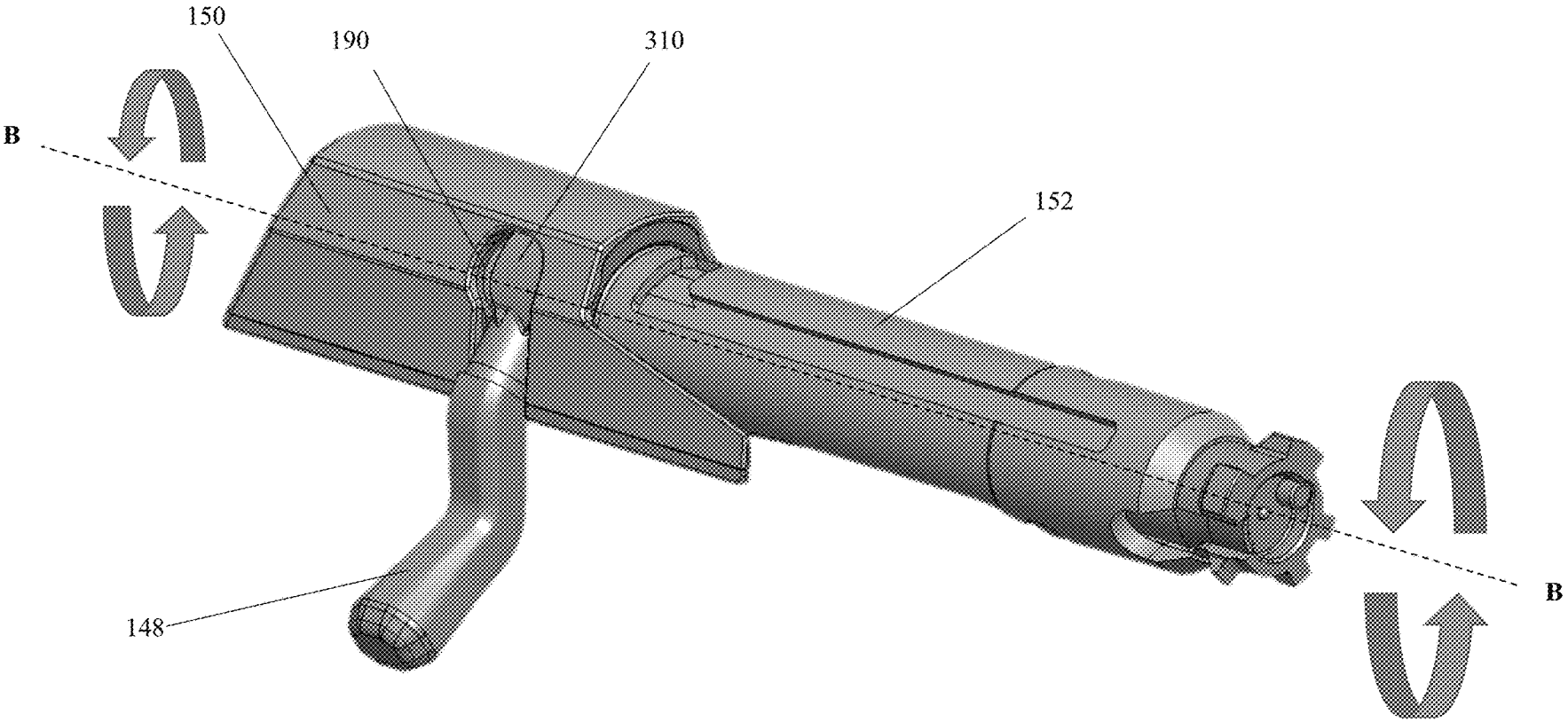
FIG. 14 is a perspective view of an example bolt assembly removed from a firearm.

FIG. 14 depicts the bolt assembly 126 after it has been removed from the firearm 100. The shroud 150 is rotatable with respect to the bolt body 152 in both directions along axis B-B. The shroud 150 can be rotated by the user's hands without using tools or supports. Rotating the shroud 150 with respect to the bolt body 152 in one direction along axis B-B allows the radial protrusion 310 of the handle 148 to clear the circumferential opening 190 of the shroud 150. Accordingly, the user can then pull the handle 148 through the circumferential opening 190 of the shroud 150 to remove the handle 148 from the bolt assembly 126. The handle 148 can be manually pulled from the bolt assembly 126 without using tools or supports. When the handle 148 is removed from the bolt assembly 126, the striker spring 262 is held by the counter bore 278 in the striker cam 266. Thus, the handle 148 can be removed from the bolt assembly 126 without disassembling the bolt body 152 from the shroud 150.

To re-assemble the handle 148 into the bolt assembly 126, the user can re-insert the handle 148 into the circumferential opening 190 of the shroud 150 while the bolt body 152 is received in the shroud 150. The chamfered edges of the protrusion 312 allow the prongs 304 of the handle 148 to lift the striker spring 262 from the counter bore 278 in the striker cam 266 such that the striker spring 262 can become seated again in the circular dish cut 300. The user can then rotate the shroud 150 with respect to the bolt body 152 so that at least a portion of the radial protrusion 310 of the handle 148 is engaged with the circumferential groove 232 of the shroud 150 such that the handle 148 is secured in the bolt assembly 126.

Figure 15:
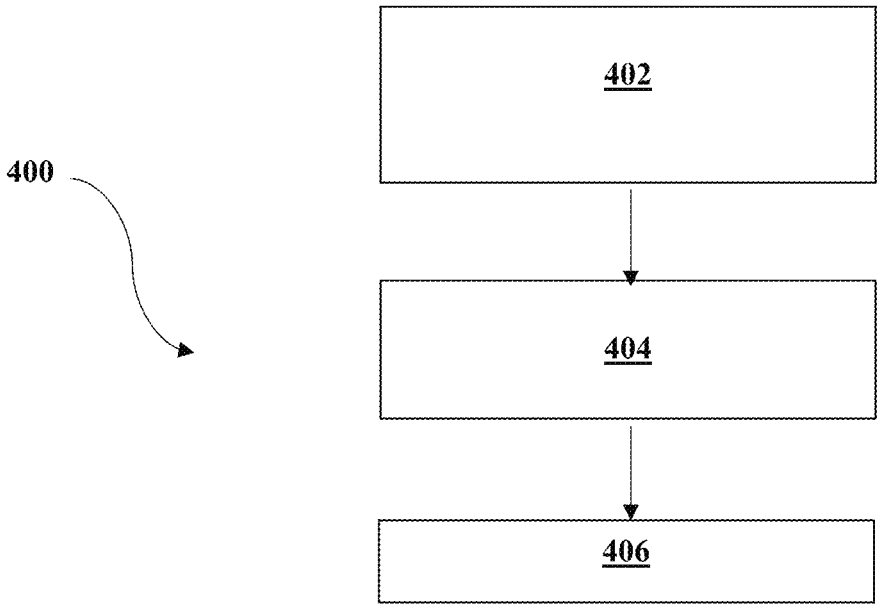
FIG. 15 is a flowchart illustrating a method of removing a bolt handle from a firearm.

FIG. 15 is a flowchart illustrating a method 400 of removing the handle 148 from the firearm 100. The method 400 includes a first step 402 of removing the bolt assembly 126 from the firearm 100. When removed from the firearm 100, the bolt assembly 126 includes the shroud 150 and the bolt body 152. Next, the method 400 includes a step 404 of rotating the shroud 150 with respect to the bolt body 152. Rotating the shroud 150 with respect to the bolt body 152 allows the handle 148 to clear the circumferential opening 190 in the shroud 150. The method 400 further includes a step 406 of pulling the bolt handle 148 from the bolt assembly 126.

Figure 16:
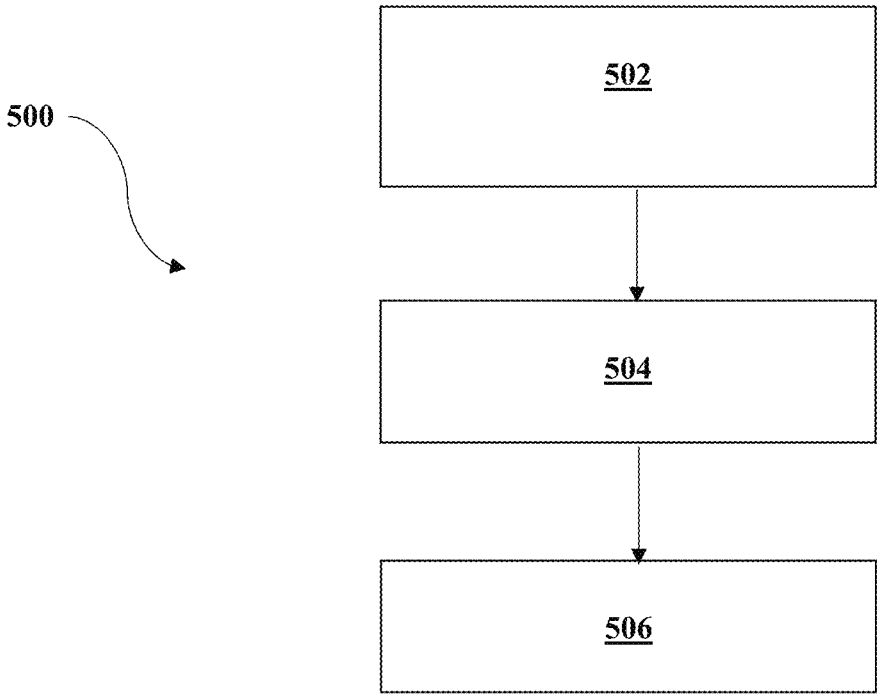
FIG. 16 is a flowchart illustrating a method of assembling a bolt handle in a firearm.

FIG. 16 is a flowchart illustrating a method 500 of assembling the bolt handle 148 with the firearm 100. The method 500 includes a step 502 of pushing the handle 148 into the bolt assembly 126. Next, the method 500 includes a step 504 of rotating the shroud 150 with respect to the bolt body 152 so that the radial protrusion 310 of the handle 148 is engaged with the circumferential groove 232 of the shroud 150 and the handle 148 is secured in the bolt assembly 126. Next, the method 500 includes a step 506 of coupling the bolt assembly 126 to the firearm 100.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

I claim:

1. A bolt assembly for a bolt action firearm, the bolt assembly comprising:

a bolt body;

a handle coupled to the bolt body; and a shroud that receives the bolt body and the handle, wherein rotation of the shroud with respect to the bolt body allows the handle to be removed from the bolt assembly, wherein the shroud is configured to remain coupled to the bolt body during removal of the handle from the bolt assembly.

2. The bolt assembly of claim 1, wherein the handle includes a protrusion that is configured to clear a circumferential opening defined in the shroud when the shroud is rotated about the bolt body.

3. The bolt assembly of claim 2, wherein the protrusion extends radially from the handle.

4. The bolt assembly of claim 1, further comprising a firing arm, wherein the handle includes prongs that define a space for coupling the handle to the bolt body without engaging the firing arm.

5. The bolt assembly of claim 4, wherein the handle includes a partially circular depression at least partially defined over the prongs for receiving an end of a striker spring.

6. The bolt assembly of claim 5, wherein each prong includes a protrusion adjacent to the partially circular depression.

7. The bolt assembly of claim 4, wherein the prongs comprise a pair of arms.

8. The bolt assembly of claim 1, further comprising a striker cam coupled to the bolt body, wherein the striker cam includes an opening for receiving the handle and a counter bore configured to receive an end of a striker spring when the handle is removed from the bolt assembly.

9. A firearm comprising the bolt assembly of claim 1.

10. A bolt handle for a firearm, the bolt handle comprising:

a shaft having a radial extension at one end and a knob at an opposite end;

a radial protrusion extending from the radial extension; and prongs extending from the radial extension, wherein the bolt handle is configured to be coupled to a bolt body received in a shroud, and wherein the bolt handle is configured to be removed from the bolt body without removing the shroud from the bolt body.

11. The bolt handle of claim 10, wherein a partially circular depression is at least partially defined over the prongs for receiving an end of a striker spring.

12. The bolt handle of claim 11, wherein each prong includes a protrusion adjacent to the partially circular depression.

13. A firearm comprising the bolt handle of claim 10.

14. A method for removing a bolt handle from a bolt action firearm, comprising:

removing a bolt assembly from the bolt action firearm, wherein the bolt assembly includes a bolt body received in a shroud, and the bolt handle is coupled to the bolt body;

rotating the shroud with respect to the bolt body to allow the bolt handle to clear a circumferential opening on the shroud, wherein the shroud is configured to remain coupled to the bolt body during removal of the bolt handle from the bolt assembly; and pulling the bolt handle to remove the bolt handle from the bolt assembly.

15. The method of claim 14, wherein the bolt handle is capable of being removed from the bolt action firearm without the use of tools.

* * * * *